United States Patent [19]

Bogaert

[11] 3,983,669

[45] Oct. 5, 1976

[54] SKYLIGHT AND FRAME THEREFORE

[76] Inventor: Pierre Emmanuel Eugene Jean Bogaert, 18, Dijk, Wemmel, Belgium

[22] Filed: Jan. 21, 1975

[21] Appl. No.: 542,852

Related U.S. Application Data

[63] Continuation of Ser. No. 342,496, March 19, 1973, abandoned.

[30] Foreign Application Priority Data

Mar. 20, 1972 Belgium ..... 780938

[52] U.S. Cl. ..... 52/200; 52/98; 52/100

[51] Int. Cl.[2] ..... E04B 7/18

[58] Field of Search ..... 52/200, 100, 209, 302, 52/98

[56] References Cited

UNITED STATES PATENTS

| | | | |
|---|---|---|---|
| 1,634,549 | 7/1927 | Laten | 52/302 X |
| 2,874,653 | 2/1959 | Ratner | 52/302 X |
| 3,410,644 | 11/1968 | Mong | 52/309 |
| 3,473,276 | 10/1969 | Back et al. | 52/200 |
| 3,638,372 | 2/1972 | Rosenthal | 52/209 X |

FOREIGN PATENTS OR APPLICATIONS

| | | | |
|---|---|---|---|
| 641,781 | 5/1962 | Canada | 52/200 |
| 1,683,523 | 10/1969 | Germany | 52/209 |
| 1,312,366 | 11/1962 | France | 52/200 |
| 1,394,162 | 2/1965 | France | 52/200 |
| 1,537,670 | 7/1968 | France | 52/209 |
| 1,534,723 | 6/1968 | France | 52/100 |
| 281,018 | 12/1964 | Netherlands | 52/209 |

*Primary Examiner*—Ernest R. Purser
*Assistant Examiner*—Leslie Braun

[57] ABSTRACT

The invention relates to a frame produced by a moulding of extrusion process for fixing a skylight on a roof; said frame is made of a mechanically strong and machinable material and has a basic profile which has at its upper portion at least one horizontal groove, for the rim of a skylight sheet, which is adjoined towards the interior of the frame by a collecting zone for water caused by condensation; orifices are provided for discharging water from the collecting zone to the exterior; the general configuration of the frame and the material used permit division of the frame by cutting at a desired level.

7 Claims, 12 Drawing Figures

SKYLIGHT AND FRAME THEREFORE

This is a continuation of application Ser. No. 342,496, filed Mar. 19, 1973, now abandoned.

The present invention relates to a frame which may for example be produced by injection moulding or another moulding process, or by extrusion, which is made from an easily machined material for the fixing of the skylight on a flat roof.

Up to the present time, standard skylight-supporting frames have been produced which could not be modified in use, that is to say these frames were used exclusively for receiving various means interposed between the frame and the skylight, the said means varying to permit various ways of using the skylight; consequently, it has been necessary to provide an entire series of accessories for receiving the skylight, these accessories varying depending on whether the skylight is to be fixed non-adjustably to the base, or is to be secured so as to be capable of opening. It was also necessary to provide means for discharging water caused by condensation.

The moulded frame according to the invention is characterised chiefly in that it is made of an easily machined material and has a basic profile which has at its upper portion at least one horizontal groove which is adjoined towards the interior by a zone for collecting water caused by condensation, orifices being provided for discharging collected water from the collecting zone to the exterior, the way of using the frame being determined by the level at which the basic profile is cut.

Figure 1:
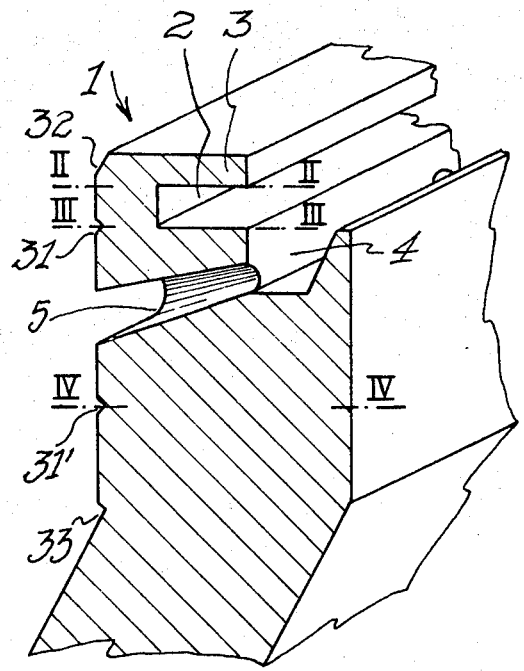
Figure 2:
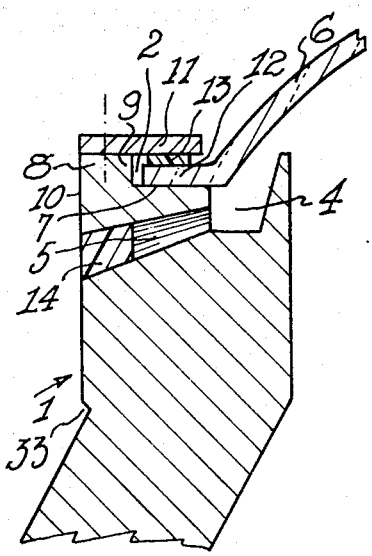
Figure 4A:
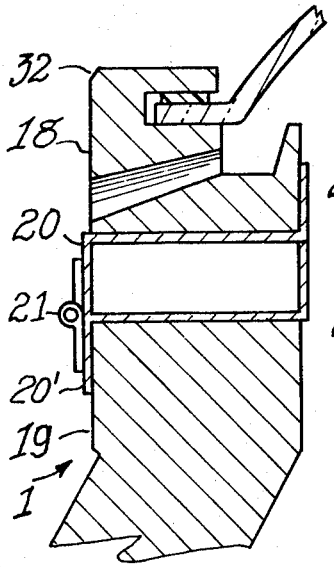
Figure 4B:
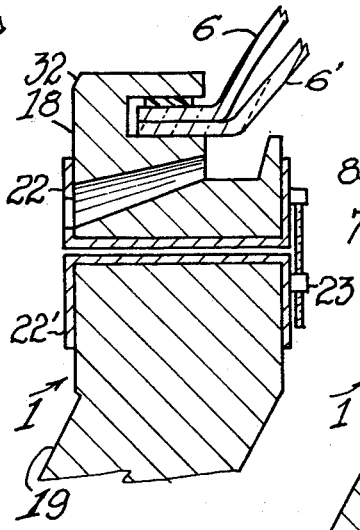
Figure 3:
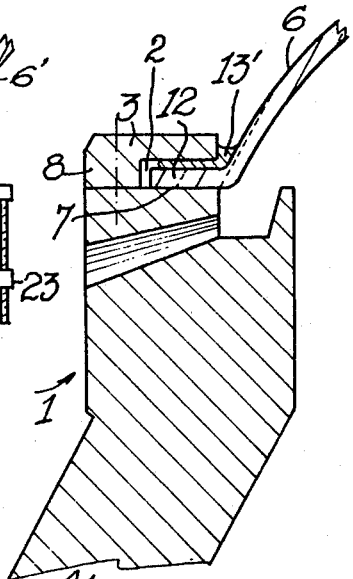
Figure 5:
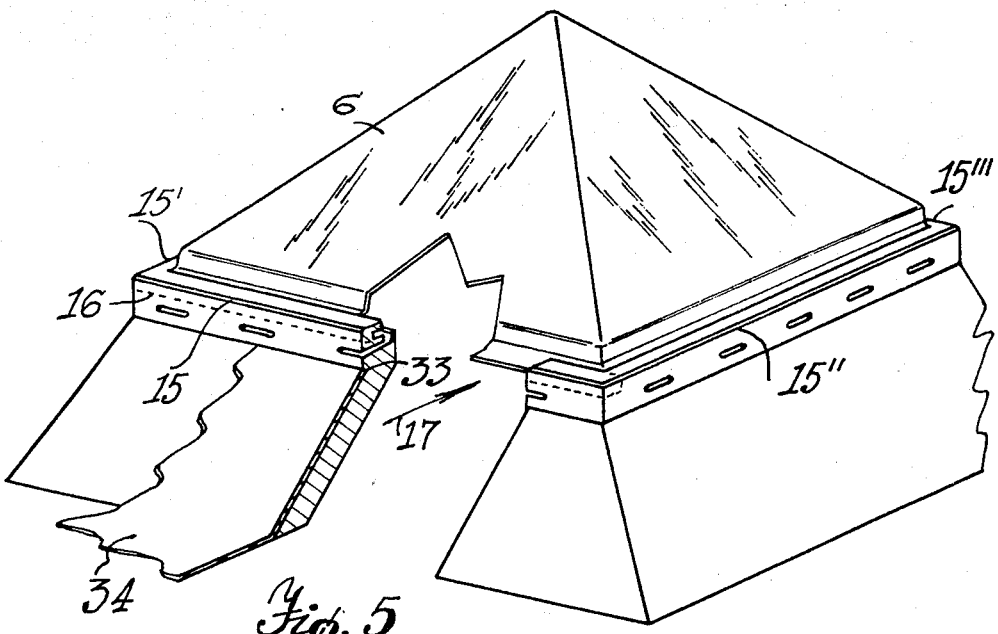
Figure 6:
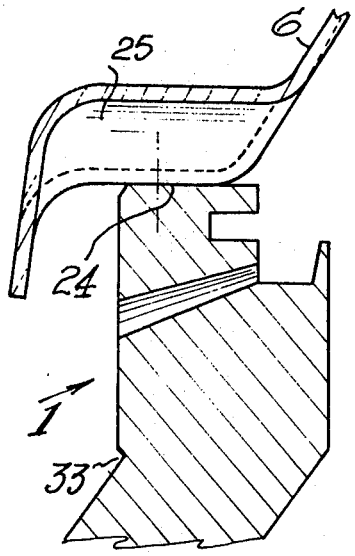
Figure 7:
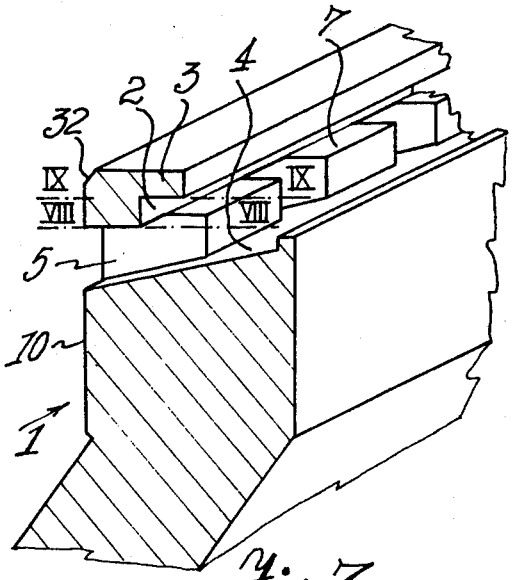
Figure 8:
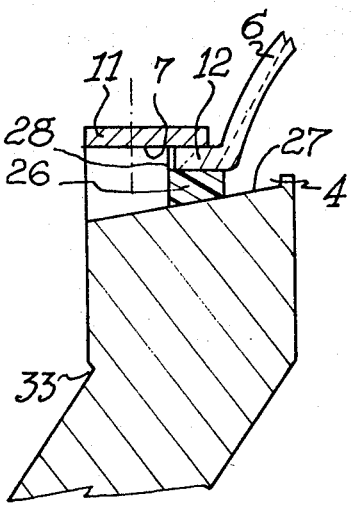
Figure 9:
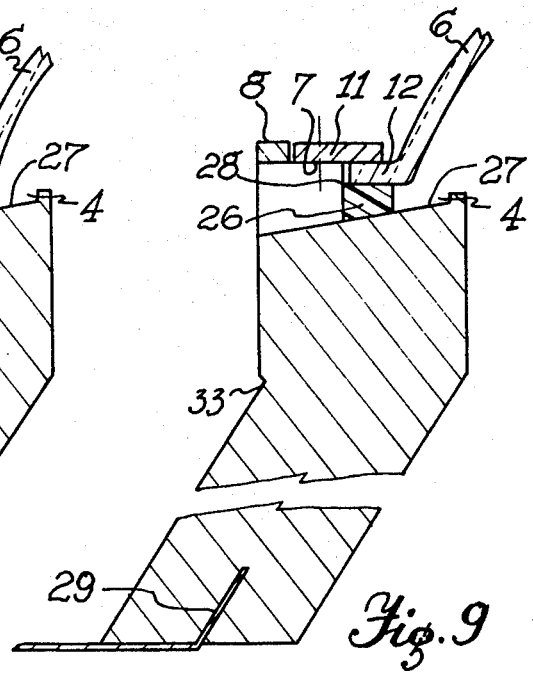
Figure 10:
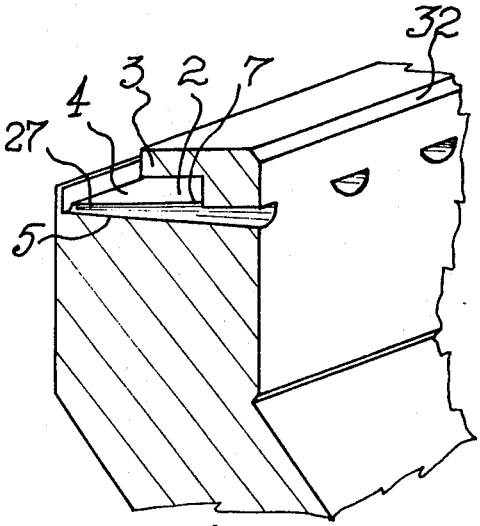
Figure 11:
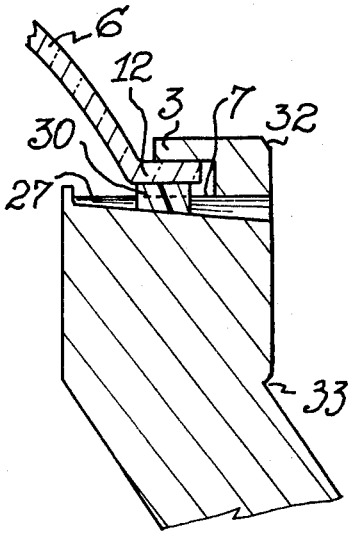

Particular embodiments of the invention will now be described with reference to the accompanying drawings, simply by way of example, wherein:

FIG. 1 shows a view in section and in perspective of the upper portion of a basic profile of a frame within the invention, FIG. 2 shows in elevation and in section one possible way of using the basic profile of FIG. 1 when it is cut along the line II—II of FIG. 1, FIG. 3 shows another way of using the profile of FIG. 1 when it is cut along the line III—III of FIG. 1, FIGS. 4*a* and 4*b* show in elevation and in section the upper portion of the frame of FIG. 1 having been cut on the line IV—IV to constitute opening the casing parts for a skylight, FIG. 5 shows in perspective and partly in section another way of using the frame profile of FIG. 1, FIG. 6 shows in elevation and in section another possible way of using the frame profile of FIG. 1, FIG. 7 shows a view in section and in perspective of another way of constructing the upper portion of a second embodiment of frame within the invention, FIG. 8 shows one possible way of using the profile of FIG. 7 when it is cut along the line VIII—VIII of FIG. 7, FIG. 9 shows a partial view in section and in elevation of the frame when the profile shown in FIG. 7 has been cut along the line IX—IX of FIG. 7, FIG. 10 shows a view perspective and in section of a third form of embodiment of a frame profile within the invention and FIG. 11 shows one possible way of using the frame profile of FIG. 10.

In the following description, it will be considered that all the profiles described are parts of a complete frame for a roof aperture which is preferably made in one piece.

Referring now to the drawings and more especially to the constructional form shown in FIG. 1 as well as the various ways of using this section shown in FIG. 1 which are illustrated in FIGS. 2 to 6, a roof aperture frame for a skylight is made of a material produced by an injection or other moulding process or extrusion which can easily be machined, and has at its upper portion a profile 1 including a horizontal groove 2 above which there is a ledge 3 and which adjoins a channel 4 used as a collecting zone for water caused by condensation, and orifices 5 connecting the channel 4 to the exterior of the frame with a downward inclination towards the exterior to ensure that water collected in the channel 4 will be discharged.

Referring more especially to FIG. 2, this shows the profile illustrated in FIG. 1 which has been cut horizontally along the line II—II of FIG. 1, that is to say the ledge 3 has been removed, and a skylight sheet 6 is placed on the lower face 7 of the groove 2 so that the thickness 8 between the bottom of the groove 9 and the external face 10 constitutes an abutment for the skylight 6.

When the profile 1 is used in this way the cut II—II is made over the entire periphery of the frame and then the skylight 6 is introduced into the space bounded by the thickness 8 over the periphery of the profile, to come to rest against the lower face 7 of the groove; the skylight 6 is then rendered fast with the said frame, for example by means of a batten 11 bearing on an edge 12 of the skylight by means of the sealing element 13 and secured to the thickness 8. This batten can be continuous over the entire periphery of the skylight or simply provided locally at various points on the periphery and it is also possible to use as the fixing batten 11 a length of scrap obtained by making the aforesaid cut on the line II—II, that is to say using the batten formed by the cut away ledge 3.

It will also be noted that in the constructional form shown in FIG. 2 there is arranged in the orifices 5 a water-pervious sealing element 14 for providing a seal against rain, wind and dust while permitting the outflow of condensed water towards the exterior. This is possible due to the fact that the seal is porous and is located in an inclined channel so that condensed water can escape by capillary action and due to gravity.

Referring now to FIG. 3, this shows a method of using the profile of FIG. 1 wherein the cut has been made on the line III—III. In this method of use, the cut is situated in prolongation of the lower face 7 of the groove 2 and there is used for securing the skylight to the profile 1 the scrap piece constituted by the cut away thickness 8 and the ledge 3, this piece being then in the form of a frame which of course is positioned very precisely on the top of the skylight frame since it matches it. In the method of use shown in FIG. 3, a mastic 13′ is used between the ledge 3 and the edge 12 of the skylight 6.

FIG. 5 shows a skylight frame wherein the skylight 6 is again fixed by cutting at the level III—III of FIG. 1, but this time not over the entire periphery of the frame but only over one side 15 as shown by the broken line 16. In this way there is obtained a cut which opens up the groove at the other three sides of the frame so as to enable the skylight to be introduced in the direction indicated by the arrow 17, making it slide along the grooves of the sides 15′—15″ of the frame until it abuts on the end groove 15‴.

The cut-away part of the side 15 is then replaced, and is fixed in the same way for example as illustrated diagrammatically in FIG. 3. In this way a particularly easy and rapid fixing of the skylight on the frame is possible, requiring only a minimum amount of labour and fixing means.

FIGS. 4*a* and 4*b* show a profile according to FIG. 1 wherein a cut has been made along the line IV—IV so as to permit the obtaining of an opening skylight, the portion of frame 18 situated above the cut made along the line IV—IV constituting the opening part whereas the lower portion 19 below the cut IV—IV constitutes the fixed casing.

In the constructional form shown in FIG. 4*b* reinforcement elements 22—22' which are U-shaped are used, the legs of the U being used also for fixing hinge parts and, at the opposite face, opeing parts 23.

However, in the case of skylights of small size it would be possible to use the frame without any reinforcement element, the external face of the profile being used for fixing hinge parts and the internal face for fixing opening handles, once the cut has been made along the line IV—IV.

As regards the fixing of the skylight, one of the methods of use shown in FIGS. 2 or 3 can be used in the case of FIGS. 4*a* and 4*b*.

As illustrated in FIG. 4*b* the frame can of course be used for fixing a double skylight 6—6'.

Finally, FIG. 6 shows a last method of using the profile shown in FIG. 1. According to this, the skylight is placed directly on the upper face 24 of the frame; in this latter method a skylight is shown which has wide passages 25 caused by deformation of the edge of the skylight to permit constant ventilation of the room below.

According to the constructional form shown in FIG. 7, the frame profile also has a groove 2 overhung by a ledge 3, a channel 4 with an inclined bottom, orifices 5 being provided which extend from the bottom of the channel 4 to the lower face 7 of the groove 2, to end at the external face 10.

FIG. 8 shows a method of using this profile in which a cut is made on the line VIII—VIII of FIG. 7, that is to say at the level of the lower face 7 of the groove 2.

In the constructional form illustrates, the skylight edge 12 rests by means of the sealing element 26, which is rigid but has open pores, on the bottom 27 of the channel 4, the external face 28 of the channel — being used as an abutment for the said skylight edge 12, while a batten 11 rests on the cut formed at the level of the lower face 7 of the groove 2.

FIG. 9 show one method of using the profile according to FIG. 7, wherein the cut has been made on the line IX—IX of FIG. 7. In this method of use, the skylight 6 again rests by means of a sealing element 26 on the bottom 27 of the channel 4 and uses an abutment the external face 28 of the said channel, while the batten 11 is arranged on the groove bottom 7 and is positioned by means of the thickness 8 remaining from the cut.

It will also be noted in this constructional form in FIG. 9 that it is possible to provide in the foot of the frame, since this is a frame made of material produced by injection or other moulding, the inclusion of a sheet 29 made for example of aluminium.

Finally, FIG. 10 shows a third constructional form of a frame profile which has a groove 2 overhung by a ledge 3 and a channel 4, the lower face 7 of the groove 2 being at the same level as the bottom 27 of the channel 4, whereas inclined orifices 5 are provided which are formed both in the bottom 27 of the channel 4 and the lower face of the groove 2. Again, this is due to the porosity of the seal located in an inclined channel.

FIG. 11 shows one way of using the profile according to FIG. 10 wherein a skylight 6 is clamped betwen the ledge 3 and a deformable open-pore sealing element 30, the said sealing element being crushed between on the one hand the bottom 27 of the channel 4 and the lower face 7 of the groove, and on the other hand the edge 12 of the skylight, whilst the said sealing element spreads into the orifices 5 and thus becomes pervious to permit the passage of water caused by condensation at such places whilst providing a seal against rain, wind and dust.

As stated hereinbefore, the various constructional forms are made from an injection-moulded or otherwise moulded material which can easily be machined, and preferably a polyurethane form of high density will be used, with an integrated skin; this is in fact a material which is strong but very easily machined, so as to permit cutting either in the factory or directly at the building site.

It will be noted that in the method of use shown in FIG. 1 it is possible to represent by notches 31—31' preferred levels of cutting which can be provided at the periphery of the frame and make it possible for cutting to be carried out without having to measure or draw lines on the frame.

Also, since the complete assembly of the skylight with the frame in the workshop is more and more in demand, it is possible to form a bevel 32 on the top of the frame to permit a plurality of entirely assembled units to be stacked on one another.

It will also be noted that in the various constructional forms shown there has been provided on the external face 18 at the bottom of the vertical portion a recess 33 with a view to receiving, when the frame is in position, a roofing sheet 34 as illustrated for example in FIG. 5.

In the above-described embodiments it can be seen that the invention provides a basic frame which may be used in various methods of fixing a skylight depending on the position at which a cut is made through the basic frame. It is thus an "all-purpose" frame usable in a simple manner in various possible ways, and by simple machining in the form of cuts, usually horizontal, which can be made in the production works or at the building site, which avoids the need for having various moulds to produce frames for each method of use.

The invention has been described above and illustrated simply by way of example and without implying any limitation, and it will be apparent that many modifications may be made to its construction without departing from the scope of the appendent claims.

What I claim is:

1. A skylight frame structure for mounting a skylight sheet over an aperture in a roof structure and the like, the frame structure comprising a unitary one piece having a plurality of upstanding walls interconnected and defining an opening therebetween and with upper and lower portions, said frame structure having a profile produced by molding, the lower portions of said walls resting on the roof structure and enclosing the aperture in the roof, and with said opening in general alignment, said piece having, when installed, an external side and an internal side, the upper portion of each of said wall of said piece having at least one substantially horizontal groove open at said internal side and directed toward the opening in said piece, said grooves being interconnected and receiving the rim of the skylight sheet, a collecting recess adjacent said grooves at said internal side for collecting water caused by condensation and the like, at least one downwardly inclined orifice extending from said collecting recess to said external side of said piece, and at least one indicating means in at least one of said walls, at an external side of the upper portion thereof, said indicating means indicating a plane along which a cut can be made from said external side to said internal side, whereby said upper portion of said piece can be separated at said groove by the cut so that the rim of different sized skylights can be inserted into said grooves while a portion of said upper portion is separated from the remainder of said upper portions.

2. A skylight frame structure according to claim 1, wherein said moulded piece is made of high-density polyurethane foam with an integral skin.

3. A skylight frame structure according to claim 2, wherein said collecting recess is a channel.

4. A skylight frame structure according to claim 1, wherein said collecting recess is a channel.

5. A skylight frame structure according to claim 4 comprising a ledge extending over said horizontal groove.

6. A skylight frame structure according to claim 5, wherein said ledge comprises a portion having a thickness determined by a cut situated in the extension of the lower face of said groove and extending over the entire periphery of said piece.

7. A skylight frame structure according to claim 6, wherein said groove is opened by a cut only over one side of said piece.

* * * * *